US009084463B2

(12) United States Patent
Merrill

(10) Patent No.: US 9,084,463 B2
(45) Date of Patent: Jul. 21, 2015

(54) FOOD AND BEVERAGE CONTAINER TRANSPORT DEVICE

(71) Applicant: Therese A. Merrill, Las Vegas, NV (US)

(72) Inventor: Therese A. Merrill, Las Vegas, NV (US)

(73) Assignee: Carryeez Tote, LLC, Las Vegas, NV (US)

( * ) Notice: Subject to any disclaimer, the term of this patent is extended or adjusted under 35 U.S.C. 154(b) by 40 days.

(21) Appl. No.: 14/200,998

(22) Filed: Mar. 7, 2014

(65) Prior Publication Data

US 2014/0251865 A1 Sep. 11, 2014

Related U.S. Application Data

(60) Provisional application No. 61/775,487, filed on Mar. 9, 2013.

(51) Int. Cl.

| | |
|---|---|
| ***A45C 11/20*** | (2006.01) |
| ***A45C 5/06*** | (2006.01) |
| ***A45C 7/00*** | (2006.01) |
| ***A45C 13/02*** | (2006.01) |

(52) U.S. Cl.

CPC . *A45C 11/20* (2013.01); *A45C 5/06* (2013.01); *A45C 7/0036* (2013.01); *A45C 13/02* (2013.01)

(58) Field of Classification Search

CPC .... A45C 11/20; B65D 1/0292; B65D 21/086; B65D 25/16

USPC ..... 206/541, 545, 546, 548, 549; 220/668, 220/666, 9.1, 9.2, 9.3, 9.4, 915.1, 915.2, 220/495.03; 383/33, 34, 34.1, 119, 121.1, 383/123

See application file for complete search history.

(56) References Cited

U.S. PATENT DOCUMENTS

| | | | | |
|---|---|---|---|---|
| 4,775,069 | A * | 10/1988 | Stonier | 220/6 |
| 6,296,165 | B1 | 10/2001 | Mears | |
| 6,474,097 | B2 * | 11/2002 | Treppedi et al. | 62/457.7 |
| 7,669,436 | B2 | 3/2010 | Mogil et al. | |
| 2002/0095947 | A1 * | 7/2002 | Treppedi et al. | 62/457.9 |
| 2006/0065655 | A1 * | 3/2006 | Taylor | 220/6 |
| 2007/0095825 | A1 * | 5/2007 | Tsao | 220/6 |
| 2008/0105695 | A1 | 5/2008 | Moran et al. | |
| 2009/0261111 | A1 * | 10/2009 | Hsu | 220/592.2 |
| 2011/0062167 | A1 * | 3/2011 | Colton et al. | 220/666 |

* cited by examiner

*Primary Examiner* — Jacob K Ackun
*Assistant Examiner* — Jenine Pagan
(74) *Attorney, Agent, or Firm* — Patentfile, LLC; Bradley C. Fach; Steven R. Kick

(57) ABSTRACT

In preferred embodiments, a novel container transport device comprising two collapsible elongate walls with the bottom of each collapsible wall joined to two opposite and parallel sides of a base and two side support walls joined to two opposite and parallel sides of the base perpendicular to the two collapsible elongate walls. In preferred embodiments, the top of each collapsible wall is joined to a parallel and opposite side of the retainer. Two side support walls are hingedly joined to two opposite and parallel sides of the retainer perpendicular to the collapsible walls. The side support walls may be moved between a first position in which the bottom of each side support wall contacts an opposite side of the base, and a second collapsed position in which the bottom of each side support wall is folded over the retainer to rest on the top of the device allowing the device to be collapsed.

11 Claims, 9 Drawing Sheets

FOOD AND BEVERAGE CONTAINER TRANSPORT DEVICE

CROSS REFERENCES TO RELATED APPLICATION

The present application claims priority to provisional patent application No. 61/775,487 filed on Mar. 9, 2013, and entitled "NOVEL BEVERAGE TRAY CONTAINER DEVICE WITH EXPANDABLE SIDEWALLS" the entire contents of the above-referenced patent application is incorporated by reference herein.

FIELD OF THE INVENTION

The present invention relates to the field of collapsible devices adapted for storing and transporting multiple beverages housed in a beverage receptacle and food containers. More specifically, the invention relates to a collapsible container device that is able to securely store and aid in the transport of travel beverage holding trays commonly employed in the takeout food industry for carrying multiple beverage cups and food containers.

BACKGROUND

Takeout beverage containers and food containers have become increasingly popular as people find the need to transport food and beverages to the home, office, or other desired locations. Beverage cup trays or receptacles are often used to transport one to four beverage cups in order to prevent spillage. These trays are typically made of cardboard or other types of disposable material and are often square or rectangular in footprint with circular indentations for accepting the base of beverage cups. Takeout food containers come in many sizes and shapes which often inhibits carrying more than one container in a person's hand.

Due to the frequent need to transport multiple beverages cups, people often find it difficult to carry one or more beverage cup trays while simultaneously operating car and building doors. The beverage cups trays also tend to slide around, especially in automobiles, often resulting in spillage. Additionally, the need to carry other items such as writing instruments, cell phones, papers, and other items can further add to beverage transport difficulties.

Other types of takeout food and beverage containers pose a similar challenge when transporting more than one container at a time. When transported in collapsible bags, the containers tend to tip or slant off level resulting in spills and other unappetizing results. Rigid container carriers are unable to collapse in size or be reconfigured to accommodate different styles and sizes of food and beverage containers.

Containers and other devices for transporting takeout food and beverage containers are known in the art. These containers frequently are of a size and shape that may be able to accommodate one or more beverage cups, but are unable to securely transport one or more beverage cup trays, see U.S. Pat. No. 6,296,164 issued on Oct. 2, 2001 to Mears et al. for example. The structure comprises a compartment for storing food along with two compartments for storing two beverage cups. Often, using a container to carry food and beverage trays necessitates the cold beverages being placed in close proximity to hot food, or hot beverages being placed in close proximity to cold food, causing undesirable temperature changes.

Another beverage cup transporting container that is known in the art comprises an insulated bag that has a main compartment that is divided into six smaller compartments. Each of the smaller compartments is able to accept one beverage cup. An example of this type of beverage cup transport container can be found through a Division of A+ Containers with model number BEVC6. This container is only able to transport six beverage cups of a limited size and is not able to store or transport beverage cup trays. Additional time is therefore required to remove the beverage cups from the beverage cup trays and to place them into the smaller compartments in the cup transporting bag.

U.S. application Ser. No. 11/931,506, filed by Moran et al. describes an insert that is placed into a cooler container with a single main compartment which accepts a certain number of beverage cups. The insert is foldable in nature and thus after multiple uses, tends to demonstrate a diminished ability to secure beverage cups. This design also necessitates additional time to transfer beverage cups from the beverage cup trays into the provided insert of the cooler container.

People that frequently carry takeout beverage cup trays and food containers often resort to using a large box or making multiple trips in order to carry all of the beverage cup trays to a desired location. Upon transport in a moving vehicle, beverage trays often slide around and tip over. Beverage cup trays placed in a large box may slide around in the box, or even the box itself may slide around in the car.

Entering buildings carrying multiple takeout beverage cup trays and food containers can also become extremely difficult as often one hand is needed to open doors while entering the building. All of these inconveniences make it a challenge to transport multiple beverages cups, beverages cups trays, and food containers from one location to another.

Therefore, a need exists for novel food and beverage container transport devices that are able to maintain a level orientation of multiple food and beverage containers during transport. There also exists a need for container transport devices that are able to collapse in size, and be reconfigurable to secure food and beverage containers of different sizes and shapes. There is a further need for container transport devices that will facilitate the secure transport of one or more beverage cup trays in addition to transporting one or more food containers from one location to another without accidently spilling the contents from within the beverage cups. Finally, there exists a need for container transport devices that are able to secure and store personal items for the transporter such as pens, cell phones, business cards, and other items.

BRIEF SUMMARY OF THE INVENTION

It is one aspect of the present invention to provide novel food and beverage container transport devices that are able to maintain a level orientation of multiple food and beverage containers during transport.

Another object of the present invention is to provide container transport devices that are able to collapse in size and be reconfigurable to secure food and beverage containers of different sizes and shapes.

An additional object of the present invention is to provide container transport devices that will facilitate the secure transport of one or more beverage cup trays in addition to transporting one or more food containers from one location to another without accidently spilling the contents from within the beverage cups and food containers.

A further object of the present invention is to provide container transport devices that are able to secure and store personal items for the transporter such as pens, cell phones, business cards, and other items.

It is one aspect of the present invention to provide a novel container transport device comprising two collapsible walls with the bottom of each collapsible wall joined to two opposite and parallel sides of a base and two side support walls joined to two opposite and parallel sides of the base perpendicular to the two collapsible walls. The top of each collapsible wall is joined to a parallel and opposite side of the retainer. Two side support walls are hingedly joined to two opposite and parallel sides of the retainer perpendicular to the collapsible walls. The side support walls may be moved between a first position in which the bottom of each side support wall contacts an opposite side of the base, and a second position in which the bottom of each side support wall is folded over the retainer to rest on the top of the device allowing the device to be collapsed. One or more lock tabs may secure the side support walls to the base or collapsible walls preventing the device from collapsing.

In some embodiments, a plurality of pockets may be positioned on the interior or exterior of the walls of the container transport device, and strips of hook fasteners as employed in hook and loop fastener systems (e.g. Velcro) may be positioned the exterior of the base of the device. In other embodiments, the container transport device may further comprise a reinforced bottom to support the beverage cup trays. In some further embodiments, the container transport device may have one or more reinforced handles to aid in carrying the device. One or more dividers that may be optionally removed to help separate the beverage cup trays may be provided. Further embodiments of the invention may comprise one or more optionally detachable straps which may be used for shoulder or hand support and to aid in the carrying and transport of the container device. In some embodiments, the container device may be made from one or more materials that are insulating in nature in order to maintain the temperature of the beverages that are being transported, while in still other embodiments, the container may be made from materials that do not provide increased temperature insulation to the beverages.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1:
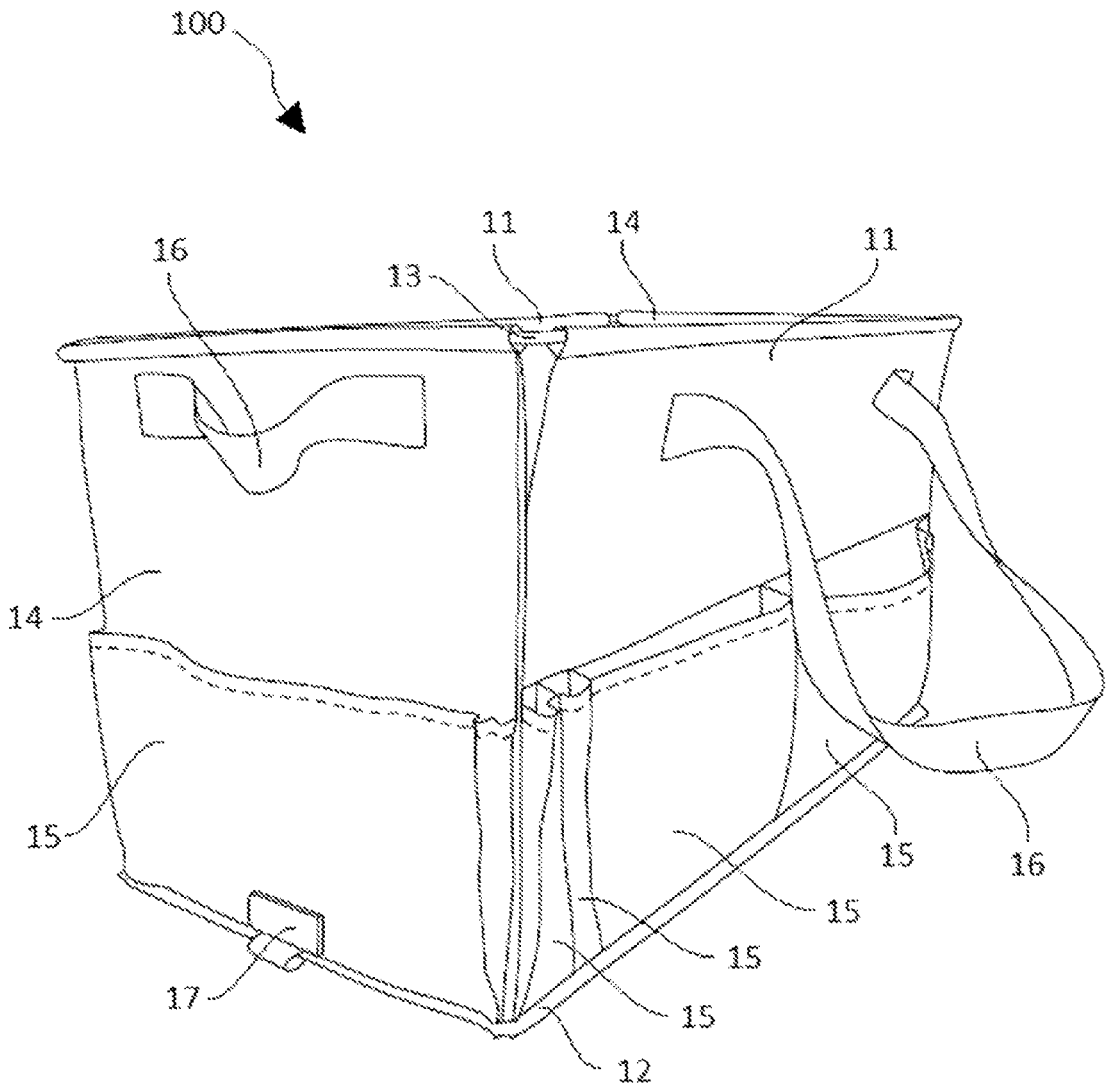
FIG. 1 depicts a perspective view of an example of a food and beverage container transport device according to various embodiments described herein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

It should be understood that for the purposes of understanding the orientation of individual elements of the invention, the terms "front" and "front face" shall generally be used to indicate a surface of an element or container transport device that when assembled in a device is positioned opposite a surface of an element or device that is described by terms including "back", "back face", and "rear" and should not unnecessarily be construed as limiting the position or orientation of said element.

It should also be understood that the terms "right" and "left" are used solely to denote opposite sides of an individual element or opposite sides of the device and should not unnecessarily be construed as limiting the position or orientation of said element.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New food and beverage container transport devices are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 7:
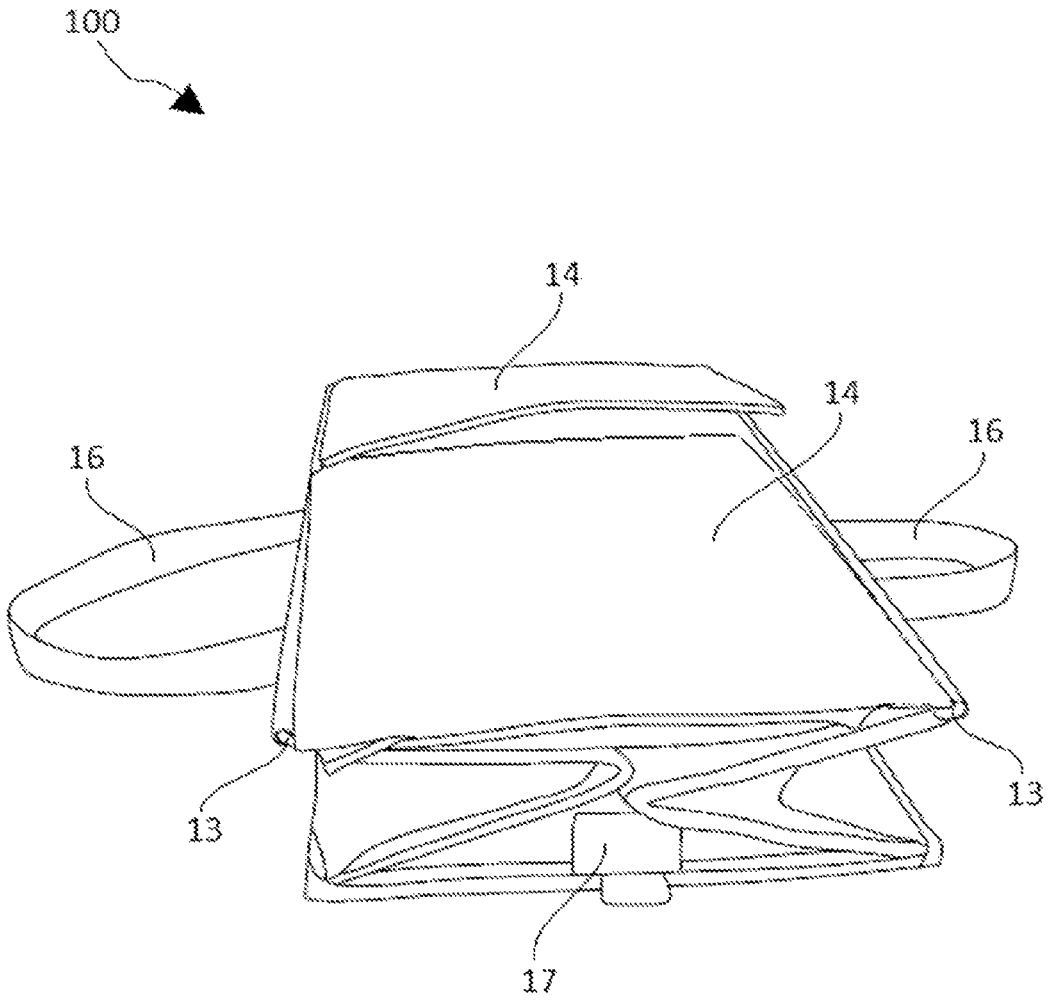
FIG. 7 depicts a perspective view of the side of a collapsed example of a food and beverage container transport device according to various embodiments described herein.
Figure 8:
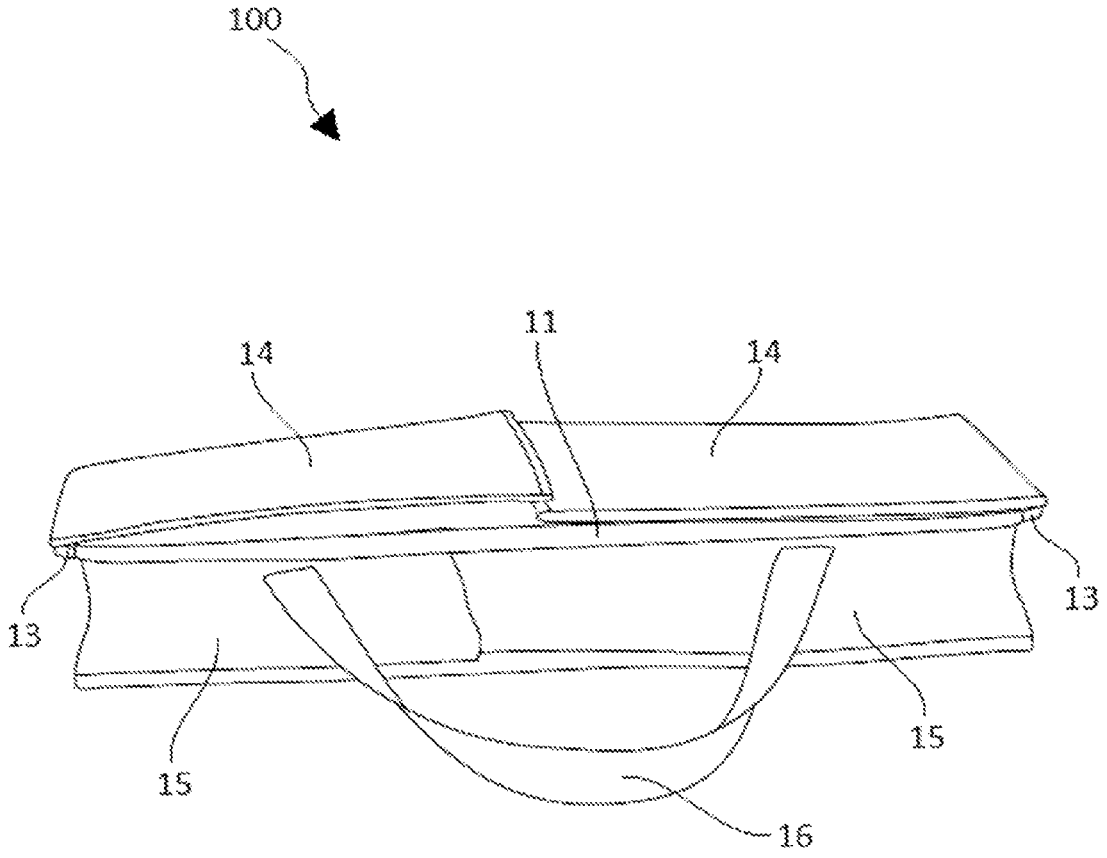
FIG. 8 illustrates a perspective view of the front of a collapsed example of a food and beverage container transport device according to various embodiments described herein.

The present invention will now be described by example and through referencing the appended figures representing preferred and alternative embodiments. FIG. 1 illustrates an example of a food and beverage container transport device ("the device") 100 according to various embodiments. In preferred embodiments, the device 100 generally comprises substantially rigid side walls surrounding a flexible inner liner 19 (FIG. 6) and a base 12. The top of each of the four walls are joined to a four sided retainer 13. Two side support walls 14 are hingedly joined to two opposing sides of the retainer 13 and may be moved between a first position in which the bottom of each side support wall 14 contacts an opposite side of the base 12, and a second position in which the bottom of each side support wall 14 may be folded over the retainer 13 to rest above the base 12 when in a collapsed position (FIGS. 7 and 8).

The base 12 is substantially rigid in nature and allows one or more food or beverage container to remain in a substantially level orientation while positioned on and supported by the base 12 in the interior of the device 100. The base 12 may be made from substantially rigid plastics such as High-density polyethylene (HDPE), other thermoplastics, metal alloys, wood, or any other suitable substantially rigid material.

Still referring to FIG. 1, in this and preferred embodiments, the two collapsible elongate walls 11 are substantially flexible or perforated along their center allowing the collapsible elongate walls 11 to be collapsed towards or extended away from the base 12. The retainer 13 is substantially rigid in nature and secures the top of each of the four walls to maintain the upper open sixth side of the device 100 which grants access to the interior. The retainer 13 may be rectangular in shape and preferably may be made from rigid metal wire or rod like material such as zinc, rigid plastics, or any other substantially rigid material.

The two side support walls 14 are substantially rigid in nature and are hingedly attached to two parallel and opposite sides of the retainer 13 at their upper side. When the lower side of each side support wall 14 is engaged to the base 12, as shown in FIG. 1, the rigid nature of the side support walls 14 prevents the retainer 13 and thus the collapsible elongate walls 11 from being collapsed towards the base 12. Once the side support walls 14 are disengaged from the base 12, the retainer 13 and and collapsible elongate walls 11 may be collapsed towards the base 12. The side support walls 14 may be made from substantially rigid plastics, metal alloys, wood, or any other suitable substantially rigid material. Preferably, the side support walls 14 may be covered with nylon, vinyl, polyester, cotton, linen, or any other suitable flexible type of natural or synthetic fibers and materials.

In preferred embodiments, the bottom of the side support walls 14 may be engaged and secured to the base 12 with one or more lock tabs 17 or by other suitable means. In this embodiment, to engage a side support wall 14, an adjacent lock tab 17 may be pressed down and away from the base 12 so that the side support wall 14 may be positioned to contact the base 12 and the lateral sides of two collapsible elongate walls 11. By releasing the lock tab 17, the lock tab 17 may return to its original position thereby applying pressure to the bottom of a side support wall 14 and securing it to the base 12 and to the lateral sides of two elongate collapsible walls 11. A side support wall 14 may be disengaged from contacting the base 12 and collapsible elongate walls 11 by applying pressure to the lock tab 17, moving it out and away from a side support wall 14, and then moving the side support wall 14 away from the base 12 and collapsible elongate walls 11.

The lock tabs 17 are preferably resilient in nature and may comprise an elastic or resilient material such as plastic or metal which is capable of flexing and returning to its original shape. In other embodiments, one or more lock tabs 17 may be configured to temporarily attach to a side support wall 14 by one or more snap type fasteners, hook and loop type fasteners, buttoning fasteners, or any other suitable type of temporarily fasteners including Velcro.

In the embodiment depicted in FIG. 1, one or more pockets 15 may be positioned on the exterior of the collapsible elongate walls 11 and on the side support walls 14 which may be of a plurality of shapes and sizes configured to hold various items such as writing instruments, note pads and paper, keys, electronic devices, and the like. Also, one or more straps 16 may be optionally attached to various surfaces of the device 100 and may be used to carry and transport the device 100. The pockets 15 and straps 16 may be made from nylon, vinyl, polyester, cotton, linen, or any other suitable flexible type of natural or synthetic fibers and materials.

Figure 2:
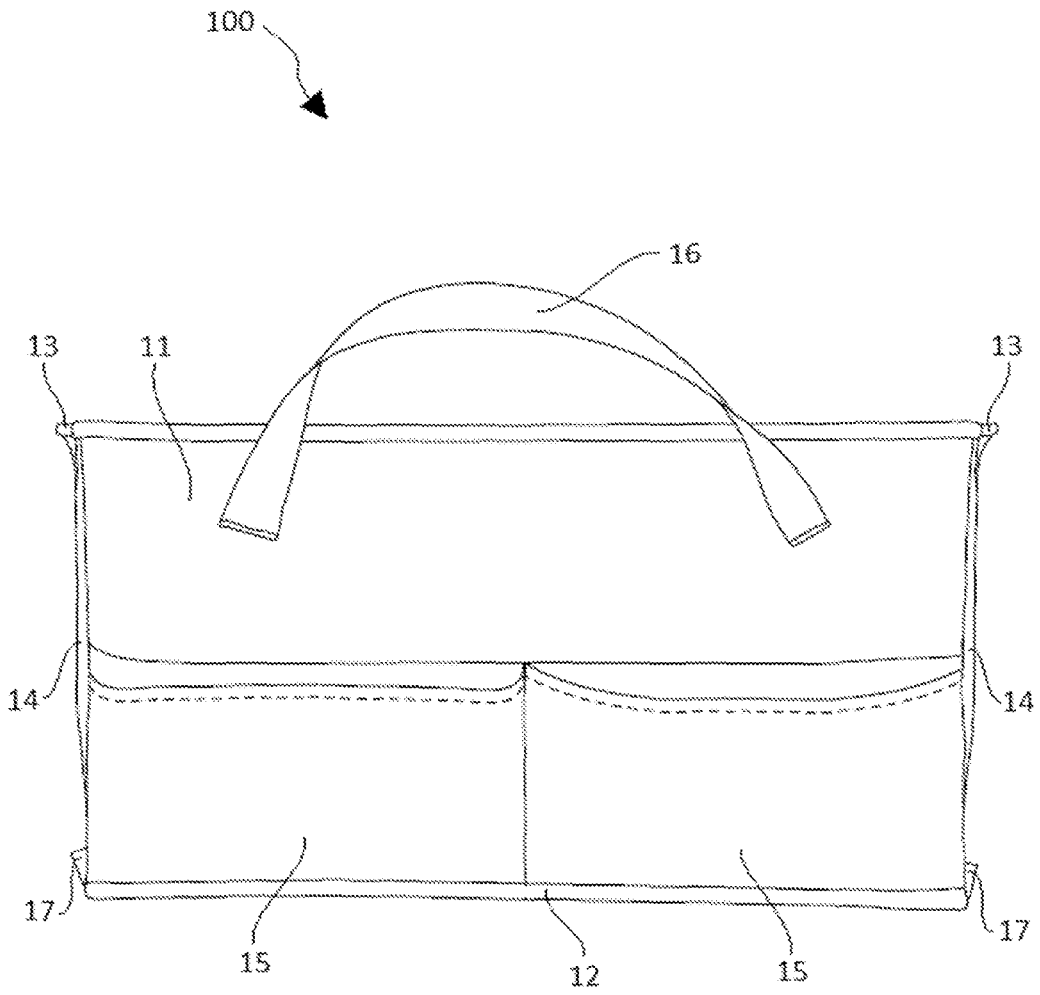
FIG. 2 illustrates an elevation view of the front of an example of a food and beverage container transport device according to various embodiments described herein.

FIG. 2 illustrates an elevation view of the front of an example of a food and beverage container transport device 100 according to various embodiments. In this view, the retainer 13 is slightly visible along the upper perimeter formed by the intersection of the four walls 11 and 14. In other embodiments, the retainer 13 may not be visible. Two lock tabs 17 are shown with each securing the lower portion of a side support wall 14 to the base 12 and optionally to the collapsible elongate walls 11. One or more pockets 15 and straps 16 may be positioned anywhere on the side support walls 14 and on the collapsible walls 11.

Figure 3:
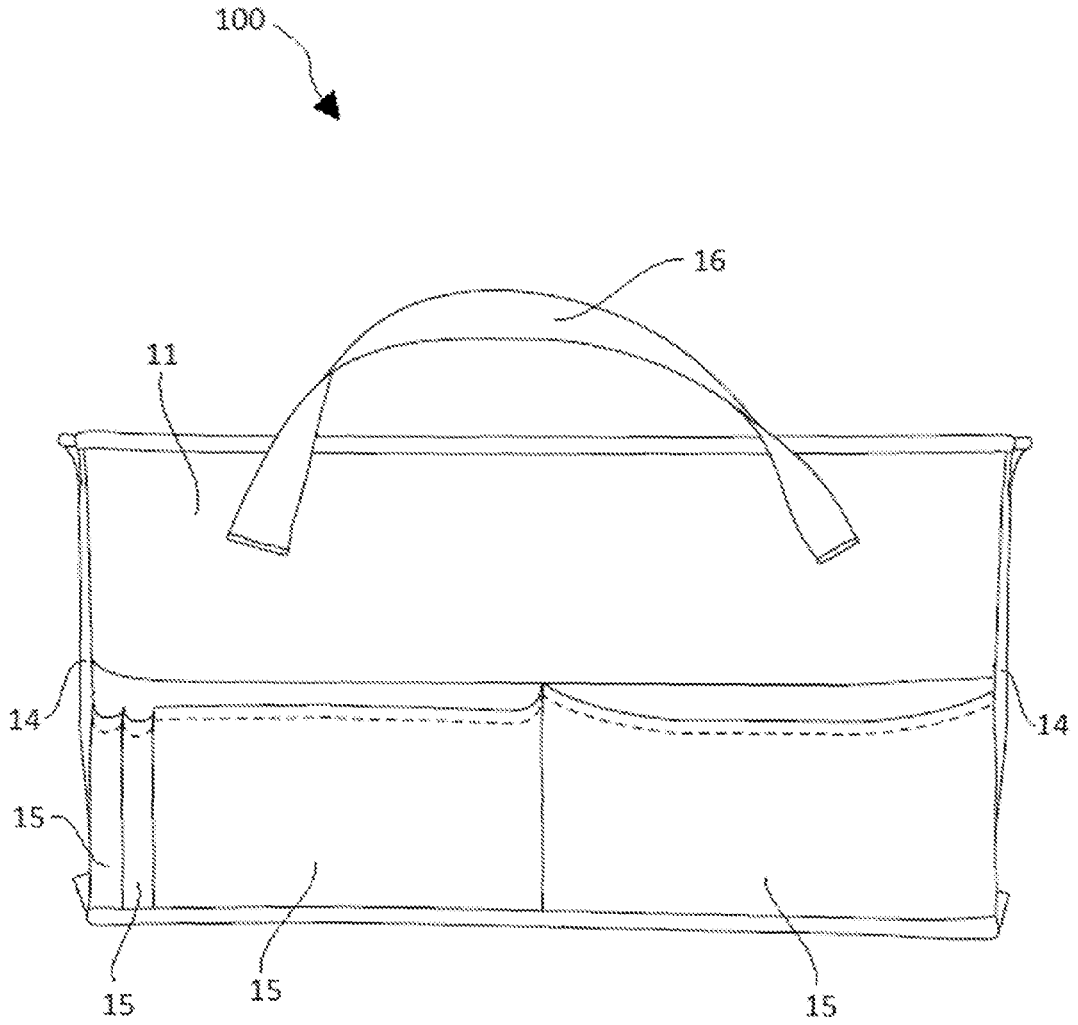
FIG. 3 shows an elevation view of the back of an example of a food and beverage container transport device according to various embodiments described herein.

FIG. 3 shows an elevation view of the back of an example of a food and beverage container transport device 100 according to various embodiments. Similar to the front of the exemplary device 100 illustrated in FIG. 2, one or more pockets 15 and straps 16 may be positioned anywhere on the side support walls 14 and on the collapsible walls 11.

Figure 4:
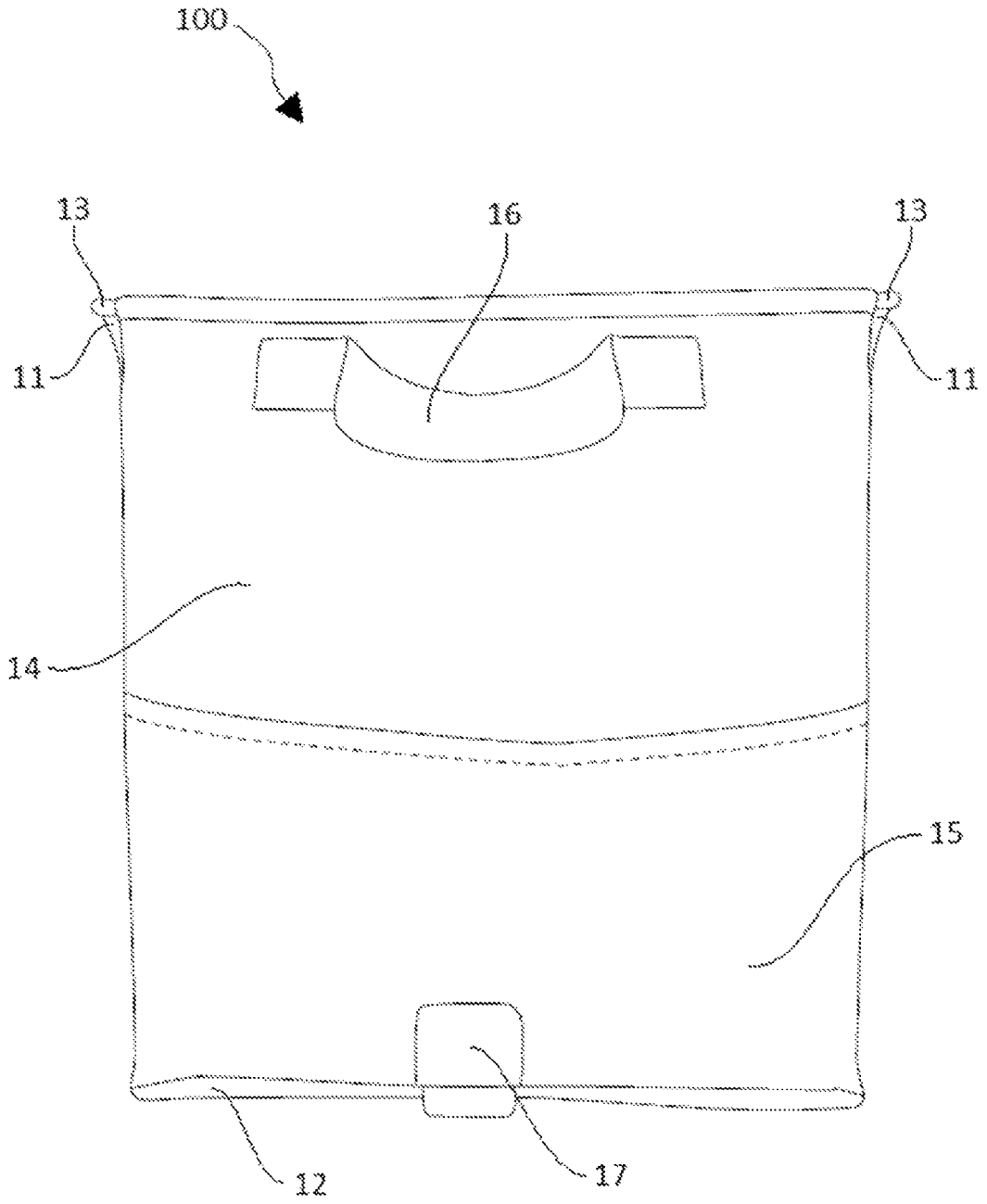
FIG. 4 depicts an elevation view of the side of an example of a food and beverage container transport device according to various embodiments described herein.

Turning now to FIG. 4, an elevation view of the side of an example of a food and beverage container transport device 100 according to various embodiments is depicted. In this embodiment, a lock tab 17 is securing a side support wall 14 to the base 12 and optionally against two collapsible elongate walls 11 thereby maintaining the retainer 13 away from the base 12 and preventing the device 100 from collapsing onto itself. The side support walls 14 may also comprise one or more pockets 15 and straps 16.

Figure 5:
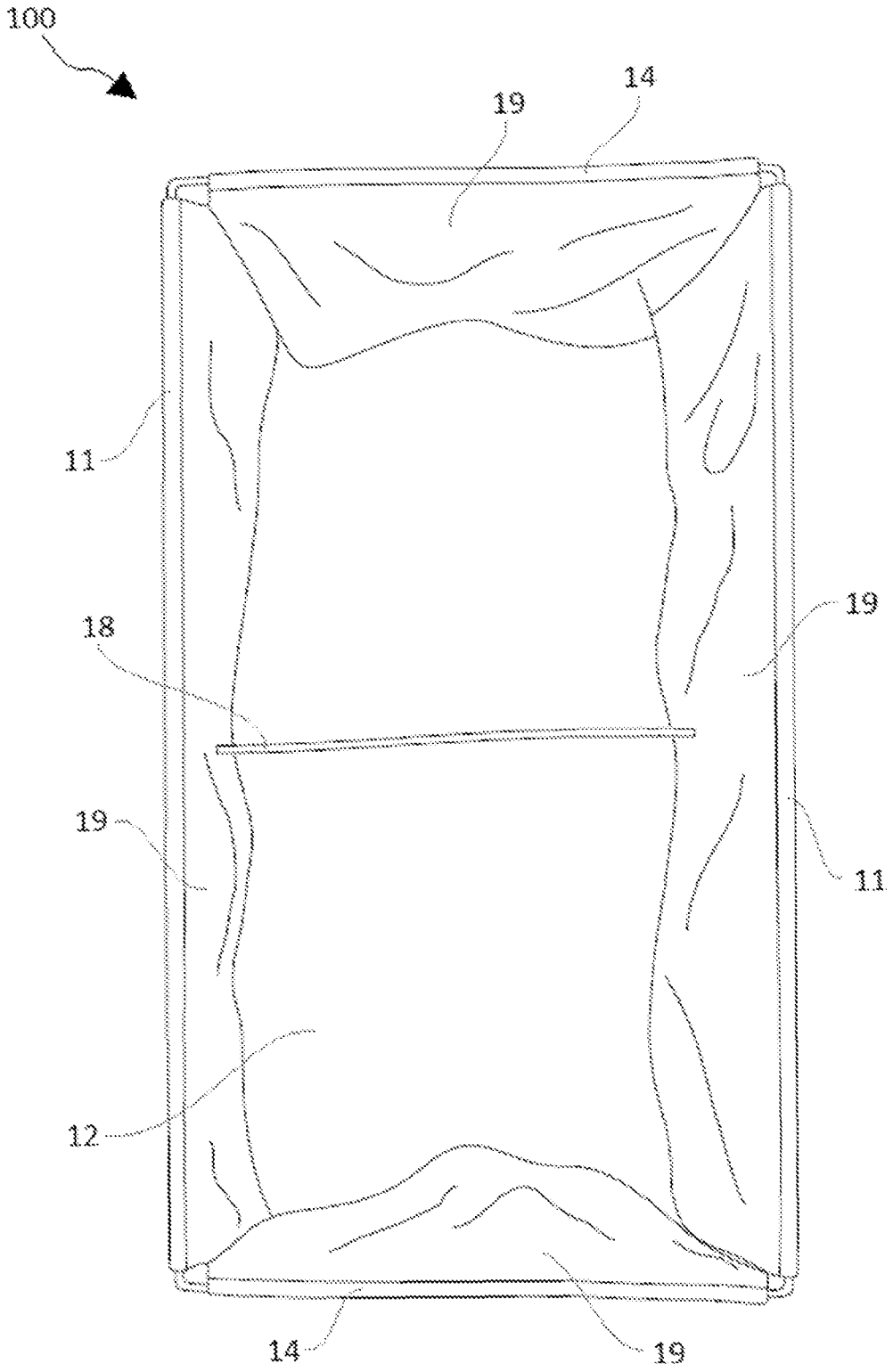
FIG. 5 illustrates a plan view of the interior of an example of a food and beverage container transport device with a divider in place according to various embodiments described herein.

FIG. 5 illustrates a plan view of the interior of an example of a food and beverage container transport device 100 according to various embodiments.

In preferred embodiments, a liner 19 may be used within the interior of the device 100 and be configured to cover at least a portion of one or more collapsible elongate walls 11, base 12, and/or side support walls 14. In other embodiments, the liner 19 may be used to within the interior of the device 100 and configured to function as one or more collapsible walls 11. The liner 19 may be made from nylon, vinyl, polyester, cotton, linen, or any other suitable flexible type of natural or synthetic fibers and materials. In preferred embodiments, the liner 19 may be of a waterproof or water resistant type material.

In this and preferred embodiments, one or more dividers 18 may be positioned in the interior of the device 100 and may be moved from a first storage position to a second dividing position. The storage position may allow a divider 18 to function as a pocket to secure items against one or more walls in the interior of the device 100. The dividing position allows the interior of the device 100 to be partitioned by a divider 18 for securement of smaller food and beverage containers. The dividers 18 may be secured in various positions by one or more snap type fasteners, hook and loop type fasteners such as Velcro, buttoning fasteners, or any other suitable type of temporarily fasteners.

In some embodiments, the dividers 18 may be collapsible in nature by being flexibly attached to the base 12 or walls 11 and 14. In further embodiments, the dividers 18 may be flexibly or temporarily attached and stored to the base 12 and/or one or more walls by a snap type fastener, hook and loop type fastener, buttoning fastener, or any other suitable temporarily fastener. In some embodiments, one or more pockets 15 may be positioned on the interior of the walls or liner 19 of the device 100.

Figure 6:
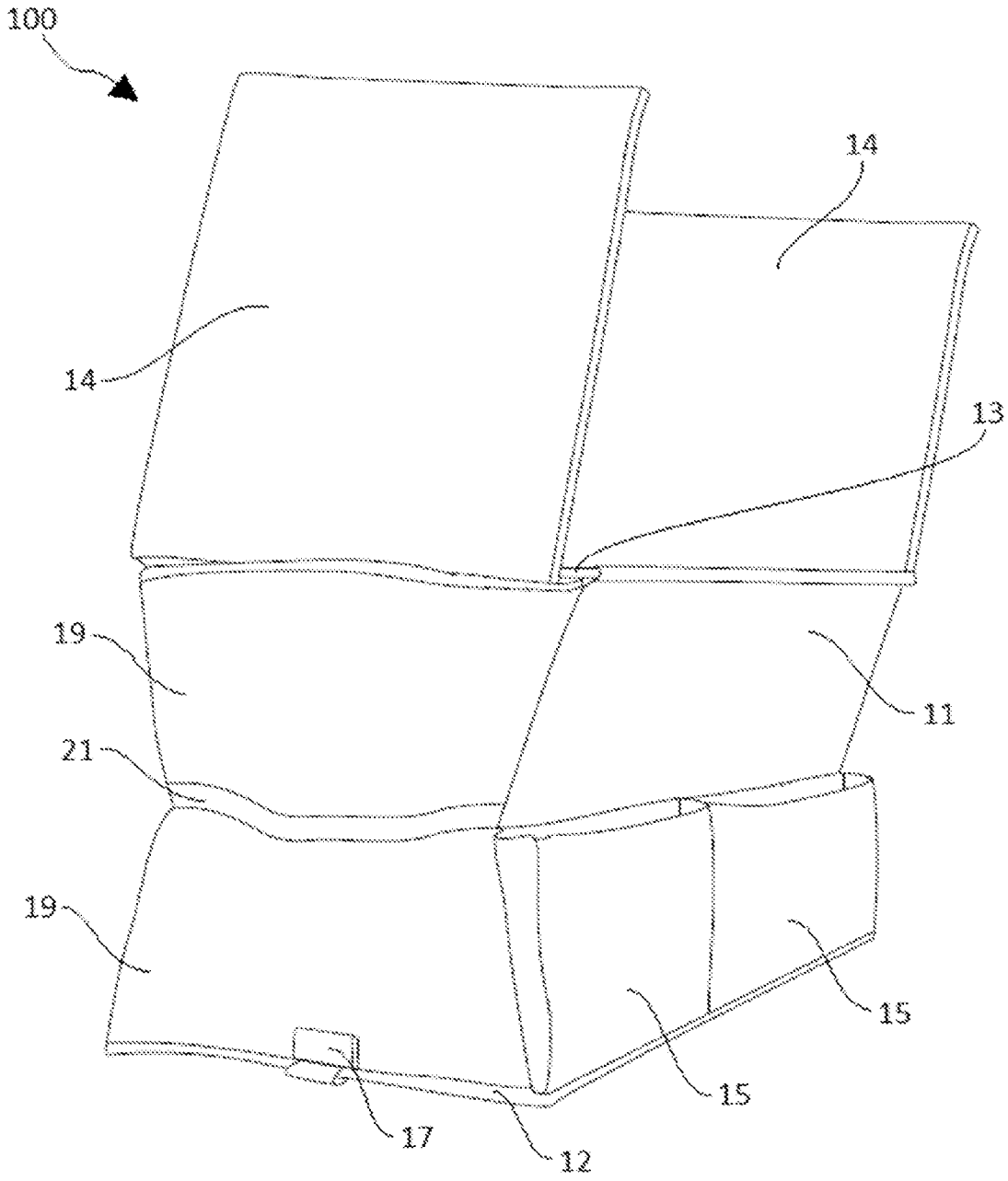
FIG. 6 shows a perspective view of a partially collapsed example of a food and beverage container transport device according to various embodiments described herein.

As perhaps best shown by FIG. 6, a perspective view of a partially collapsed example of a food and beverage container transport device 100 according to various embodiments is illustrated. In this example, the bottom of two side support walls 14 have been pivoted up and away from the base 12 and two collapsible elongate walls 11, of which only one is visible, while remaining hingedly attached to the retainer 13 so that a portion of an optional liner 19 may be seen. Without the support of side support walls 14, the retainer 13 and collapsible elongate walls 11 may be collapsed towards the base 12. In preferred embodiments, the device 100 may be collapsed by disengaging a lock tab 17 from each side support wall 14, moving each side support wall 14 up and away from contacting the base 12 and the collapsible elongate walls 11, and pressing the retainer 13 towards the base 12.

In preferred embodiments, one or more wall tethers 21 may be used to secure two opposite and parallel collapsible elongate walls 11 together. The wall tethers 21 may be elastic in nature to allow the collapsible elongate walls 11 to flex away from each other thereby allowing the interior of the device 100 to accommodate different sizes and shapes of food and beverage containers. The wall tethers 21 may also function to contact the side support walls 14 while the side support walls 14 are secured by a lock tab 17.

A perspective view of the side of a collapsed example of a food and beverage container transport device 100 according to various embodiments in depicted in FIG. 7. The two side support walls 14 are shown pivoted around the retainer 13 so that the bottom portions of the side support walls 14 that may be engaged by a lock tab 17 when the device 100 is not collapsed, are now positioned on top of the device 100 and covering its interior. Also depicted are two straps 16.

FIG. 8 illustrates a perspective view of the front of a collapsed example of a food and beverage container transport device 100 according to various embodiments also showing two side support walls 14 pivoted around the retainer 13 so that the bottom portions of the side support walls 14 that may be engaged by a lock tab 17 (FIGS. 1, 2, 3, 4, 6, and 7) when the device 100 is not collapsed, are now positioned on top of the device 100 and covering its interior. One or more pockets 15 on a collapsed wall 11 and a strap 16 can also be seen.

Figure 9:
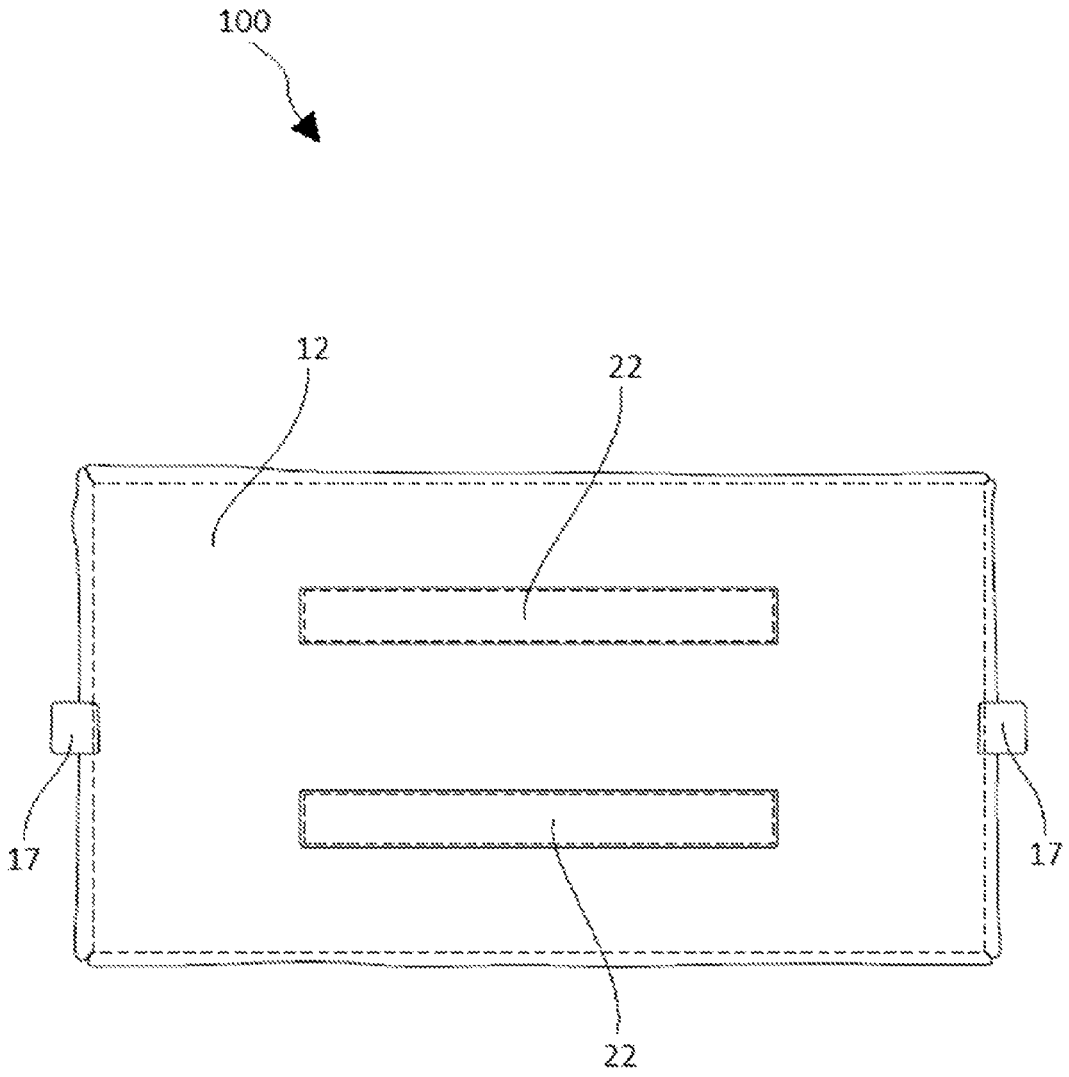
FIG. 9 shows a plan view of the bottom of an example of a food and beverage container transport device according to various embodiments described herein.

Turning now to FIG. 9, a plan view of the bottom of an example of a food and beverage container transport device 100 according to various embodiments is shown. Two lock tabs 17 are joined to opposite and parallel sides of the base 12 of the device 100. The lock tabs 17 may be joined to the base 12 by stitching, adhesive bonding, heat bonding, or any other suitable joining technique.

In some embodiments, one or more transport stops 22 such rubber strips or hook and loop fasteners including Velcro, may be positioned on the base 12 and may function to inhibit the device 100 from sliding on surfaces such as automobile floors. In other embodiments, the transport stops 22 may comprise cleats or other similar shaped structures which may be made from rubber, plastic, metal alloys, or any other durable material and configured to inhibit the device 100 from sliding on surfaces or to raise the device 100 above surfaces. The transport stops 22 may be joined to the base 12 by stitching, adhesive bonding, heat bonding, or any other suitable joining technique.

In some alternative embodiments, the device 100 may comprise one, two, three, or four support walls each configured to provide rigid support for the device when in a first erect (non-collapsed) position and each configured to disengage from a locking tab to fold onto the device in a second collapsed position. In yet further alternative embodiments, the elongate walls 11 may be configured with a substantially rigid material to act as support walls and the side support walls 14 may be configured to collapse.

One skilled in the art will immediately recognize that while the device 100 provides a novel transport for food and beverage containers, it also may be used to provide a novel transport for other types and sizes of items as well.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A container transport device, the device comprising:

a) a base;

b) a top support retainer;

c) two collapsible elongate walls wherein a bottom of each collapsible elongate wall is joined to an opposite and parallel side of the base and a top of each collapsible elongate wall is joined to an opposite and parallel side of the support retainer;

d) a first side support wall of substantially rigid material wherein the first side support wall is hingedly joined to the top support retainer perpendicular to the two collapsible elongate walls;

a second side support wall of substantially rigid material opposite to the first side support wall wherein the second side support wall is hingedly joined to the top support retainer perpendicular to the two collapsible elongate walls; and wherein the first and second side support walls are configured to transition between a first position in which a bottom of the first and second side support walls contacts a side of the base; and a second collapsed position in which the bottom of the first and second side support walls are pivoted around the outside of the container away from the base and folded over the top support retainer to rest on the top of the device.

2. The device of claim 1 further comprising a lock tab configured to secure the two side support walls to the base preventing the device from collapsing onto itself.

3. The device of claim 2 wherein the lock tab is made of a substantially rigid material capable of flexing and returning to its original shape.

4. The device of claim 1 further comprising a flexible inner liner located interior to the collapsible elongate walls and first and second side support walls.

5. The device of claim 1 further comprising a plurality of storage pockets located on the exterior surface of the collapsible elongate walls and first and second side support walls.

6. The device of claim 5 further comprising a divider positioned within the interior of the device.

7. The device of claim 6 wherein the top support retainer is a rod with four right angles.

8. The device of claim 1 wherein the top support retainer is a metal rod.

9. The device of claim 8 wherein the metal rod is a zinc rod.

10. The device of claim 8 wherein the top support retainer is a metal rod adapted so that the first and second side support walls may pivot around and over the metal rod.

11. The device of claim 10 wherein the first and second side support walls pivot around and over the top support retainer to cover the interior of the device in the second collapsed position.

* * * * *